US011534889B2

(12) United States Patent
Ahn

(10) Patent No.: US 11,534,889 B2
(45) Date of Patent: Dec. 27, 2022

(54) POLISHING PAD FOR WAFER POLISHING APPARATUS AND MANUFACTURING METHOD THEREFOR

(71) Applicant: SK SILTRON CO., LTD., Gumi-si (KR)

(72) Inventor: Jin Woo Ahn, Gumi-si (KR)

(73) Assignee: SK SILTRON CO., LTD., Gumi-si (KR)

( * ) Notice: Subject to any disclaimer, the term of this patent is extended or adjusted under 35 U.S.C. 154(b) by 394 days.

(21) Appl. No.: 16/762,291

(22) PCT Filed: Jun. 4, 2018

(86) PCT No.: PCT/KR2018/006352

§ 371 (c)(1),
(2) Date: May 7, 2020

(87) PCT Pub. No.: WO2019/151584

PCT Pub. Date: Aug. 8, 2019

(65) Prior Publication Data

US 2020/0353587 A1 Nov. 12, 2020

(30) Foreign Application Priority Data

Feb. 5, 2018 (KR) ..... 10-2018-0014011

(51) Int. Cl.

| | |
|---|---|
| ***B24B 37/26*** | (2012.01) |
| ***B24B 37/013*** | (2012.01) |
| ***B24B 37/22*** | (2012.01) |

(52) U.S. Cl.

CPC ..... *B24B 37/26* (2013.01); *B24B 37/013* (2013.01); *B24B 37/22* (2013.01)

(58) Field of Classification Search

CPC ..... B24B 37/26; B24B 37/013; B24B 37/22

(Continued)

(56) References Cited

U.S. PATENT DOCUMENTS

| | | | |
|---|---|---|---|
| 5,882,251 A | 3/1999 | Berman et al. | |
| 6,685,548 B2 * | 2/2004 | Chen | B24B 37/26 451/526 |

(Continued)

FOREIGN PATENT DOCUMENTS

| | | |
|---|---|---|
| CN | 2936578 | 8/2007 |
| EP | 1 303 381 | 4/2003 |

(Continued)

OTHER PUBLICATIONS

International Search Report dated Oct. 26, 2018 issued in Application No. PCT/KR2018/006352.

(Continued)

*Primary Examiner* — Joseph J Hail
*Assistant Examiner* — Shantese L McDonald
(74) *Attorney, Agent, or Firm* — Ked & Associates, LLP

(57) ABSTRACT

The present invention provides a polishing pad for a wafer polishing apparatus, comprising: an upper pad having a front surface part, which has a cut surface and is in contact with a wafer, a rear surface part positioned on the lower part of the front surface part, and a plurality of grid grooves passing through the front surface part and the rear surface part; a lower pad, which is arranged on the lower part of the upper pad and can be attached to a surface plate; and an adhesion part positioned between the upper pad and the lower pad to couple the upper pad with the lower pad.

6 Claims, 6 Drawing Sheets

(58) Field of Classification Search
USPC ..... 451/5, 528, 59, 527, 533
See application file for complete search history.

(56) References Cited

U.S. PATENT DOCUMENTS

| | | | | |
|---|---|---|---|---|
| 2006/0046622 | A1* | 3/2006 | Prasad | B24B 37/26 451/41 |
| 2009/0047884 | A1* | 2/2009 | Swisher | B24B 37/26 451/533 |
| 2009/0075568 | A1* | 3/2009 | Kimura | B24D 3/32 51/293 |
| 2010/0207057 | A1* | 8/2010 | Nitta | H01L 21/3212 252/79.1 |
| 2014/0378035 | A1* | 12/2014 | Noro | B24B 37/26 451/528 |
| 2019/0084120 | A1* | 3/2019 | Pisklak | B24B 37/205 |

FOREIGN PATENT DOCUMENTS

| | | |
|---|---|---|
| EP | 2 757 578 | 7/2014 |
| JP | 11-077518 | 3/1999 |
| JP | H11-156699 | 6/1999 |
| JP | 2008-229807 | 10/2008 |
| JP | 2013-208687 | 10/2013 |
| JP | 2017-185557 | 10/2017 |
| KR | 10-2007-0073944 | 7/2007 |
| KR | 10-2008-0037693 | 4/2008 |
| KR | 10-2014-0014425 | 2/2014 |
| KR | 10-2014-0062095 | 5/2014 |
| TW | 201609314 | 3/2016 |
| TW | I595968 | 8/2017 |
| WO | WO 2013/039181 | 3/2013 |

OTHER PUBLICATIONS

Chinese Office Action dated Apr. 14, 2021 issued in Application No. 201880077085.X (English translation attached).
Japanese Office Action dated Jul. 6, 2021 issued in Application No. 2020-526265.
European Search Report dated Jul. 21, 2021 issued in Application No. 18903372.3.

* cited by examiner

POLISHING PAD FOR WAFER POLISHING APPARATUS AND MANUFACTURING METHOD THEREFOR

CROSS-REFERENCE TO RELATED PATENT APPLICATIONS

This application is a U.S. National Stage Application under 35 U.S.C. § 371 of PCT Application No. PCT/KR2018/006352, filed Jun. 4, 2018, which claims priority to Korean Patent Application No. 10-2018-0014011, filed Feb. 5, 2018, whose entire disclosures are hereby incorporated by reference.

TECHNICAL FIELD

The present invention relates to a wafer polishing apparatus, and more particularly to a polishing pad used to polish a wafer.

BACKGROUND ART

A silicon wafer manufacturing process includes a single crystal growth process for producing a single-crystal ingot, a slicing process for slicing the single-crystal ingot to obtain a thin disk-shaped wafer, an edge grinding process for machining the outer circumferential portion of the wafer obtained through the slicing process in order to prevent cracking or distortion of the wafer, a lapping process for removing remaining damage to the wafer due to mechanical processing, a polishing process for mirror-polishing the wafer, and a cleaning process for removing an abrasive or foreign substances adhered to the polished wafer.

Among these processes, the wafer polishing process may be performed through various steps, including first polishing, second polishing, third polishing, and the like, and may be performed using a wafer polishing apparatus.

FIG. 1 is a perspective view of a general wafer polishing apparatus, FIG. 2 illustrates a side section of the surface of an example of the polishing pad of FIG. 1, FIG. 3 is a plan view of another example of the polishing pad of FIG. 1, and FIG. 4 is a view showing a method of forming grooves in the polishing pad through hot press processing and cutting processing.

As shown in FIG. 1, a general wafer polishing apparatus may include a surface plate 11, to which a polishing pad 13 is attached, a polishing head 21 configured to surround a wafer W and rotate on the surface plate 11, and a slurry spray nozzle 30 configured to supply slurry S to the polishing pad 13.

During a polishing process, the surface plate 11 may be rotated by a surface plate rotation shaft 12, and the polishing head 21 may be rotated by a head rotation shaft 22 in the state of being in close contact with the polishing pad 13. In this case, the slurry S supplied by the slurry spray nozzle 30 may polish the wafer W, which is in contact with the polishing pad 13, while infiltrating into the wafer W located on the polishing head 21.

Referring to FIG. 2, in a final polishing (FP) process, a porous polishing pad 13 having therein a plurality of pores P is used to remove damage to the surface of the wafer. The polishing pad 13 having this configuration has the same structure as a backing film for supporting the wafer W. Surface tension is generated at the surface of the polishing pad 13 that is in contact with the wafer W. Surface tension tends to increase as the size of the wafer W increases.

In particular, because the wafer W of 300 mm or more greatly increases surface tension, even when the polishing process is completed, the polishing pad 13 is maintained in the state in which the wafer W is adsorbed thereon, thus making it difficult to separate the wafer W from the polishing pad 13.

In order to solve this problem and realize smooth supply of slurry to the surface of the wafer, as shown in FIG. 3, a polishing pad 13*a* having lattice-shaped grooves G formed in the surface thereof may be used.

More specifically, the lattice-shaped grooves G may be formed in the surface of a polishing pad 13*a*-1 or 13*a*-2 through hot press processing in a high-temperature and high-pressure environment, as shown in FIG. 4(A), or through cutting processing using a graver, as shown in FIG. 4(B).

However, hot press processing has a problem in that the contact surface of the polishing pad 13*a*-1 is thermally deformed when pressed by a press (not shown), whereby the surface in which the grooves G are formed is hardened. The polishing pad 13*a*-1 manufactured using this method causes a phenomenon in which stress is concentrated on the edge of the wafer W that is adjacent to the grooves G during the wafer polishing process, thus leading to reduced flatness of the wafer.

In addition, in the case of the polishing pad 13-2 manufactured using cutting processing, because the surface finish of a cut surface is rough, impurities generated during cutting of the grooves G remain in the grooves G, thus leading to degradation in localized light scattering (LLS) quality.

DISCLOSURE

Technical Problem

Therefore, the present invention provides a polishing pad for a wafer polishing apparatus and a manufacturing method therefor for improving wafer polishing quality by preventing reduced flatness of a wafer or degradation in LLS quality while a wafer polishing process is performed.

Technical Solution

The present invention provides a polishing pad for a wafer polishing apparatus, including an upper pad including a front portion having a cut surface and configured to come into contact with a wafer, a back portion located below the front portion, and a plurality of grid grooves penetrating the front portion and the back portion, a lower pad disposed below the upper pad and configured to be attachable to a surface plate, and an adhesive part located between the upper pad and the lower pad and configured to combine the upper pad and the lower pad.

The grid grooves may be formed such that the entrance area that comes into contact with a wafer is smaller than the bottom area.

The grid grooves may have a trapezoidal-shaped side section in which the bottom length is greater than the top length.

The grid grooves may be formed by buffing the front portion of the upper pad in which the edges of wedge grooves formed through hot pressing processing performed on the back portion of the upper pad are included.

The upper pad may further include film-coated surfaces coated on the front portion and the back portion, and the grid grooves may have the film-coated surfaces as inner walls.

The adhesive part may be an adhesive or an adhesive tape to which the back portion of the upper pad and a front portion of the lower pad are attached.

Cutting processing may be performed on the polishing pad having the grid grooves formed therein.

The upper pad may include a porous nap layer, and the lower pad may include a non-woven fabric layer.

In addition, the present invention provides a method of manufacturing a polishing pad for a wafer polishing apparatus, the method including a film coating step of coating a film on a nap layer, a grooving step of forming wedge grooves in a back portion of the nap layer, a lamination step of bonding a non-woven fabric layer to the back portion of the nap layer, and a buffing step of buffing a front portion of the nap layer to form grid grooves.

The grooving step may be performed through hot pressing processing.

In the lamination step, the nap layer and the non-woven fabric layer may be combined using an adhesive or an adhesive tape.

In the buffing step, the front portion of the upper pad in which the edges of the wedge grooves are included may be cut such that the grid grooves have a side section in which the bottom length is greater than the top length.

After the buffing step, a cutting step of cutting the polishing pad to an arbitrary size and shape may be further performed.

Before the film coating step, a mixing step of mixing raw materials of the nap layer may be performed.

Advantageous Effects

According to a polishing pad for a wafer polishing apparatus and a manufacturing method therefor of the present invention, grid grooves, which are formed such that an entrance area contacting a wafer is smaller than a bottom area (e.g. a trapezoidal shape), may secure the smooth flow of slurry, may mitigate excessive surface tension with respect to a wafer, and may prevent reduced flatness of a wafer or degradation in LLS quality attributable to impurities during a wafer polishing process.

BEST MODE

Figure 1:
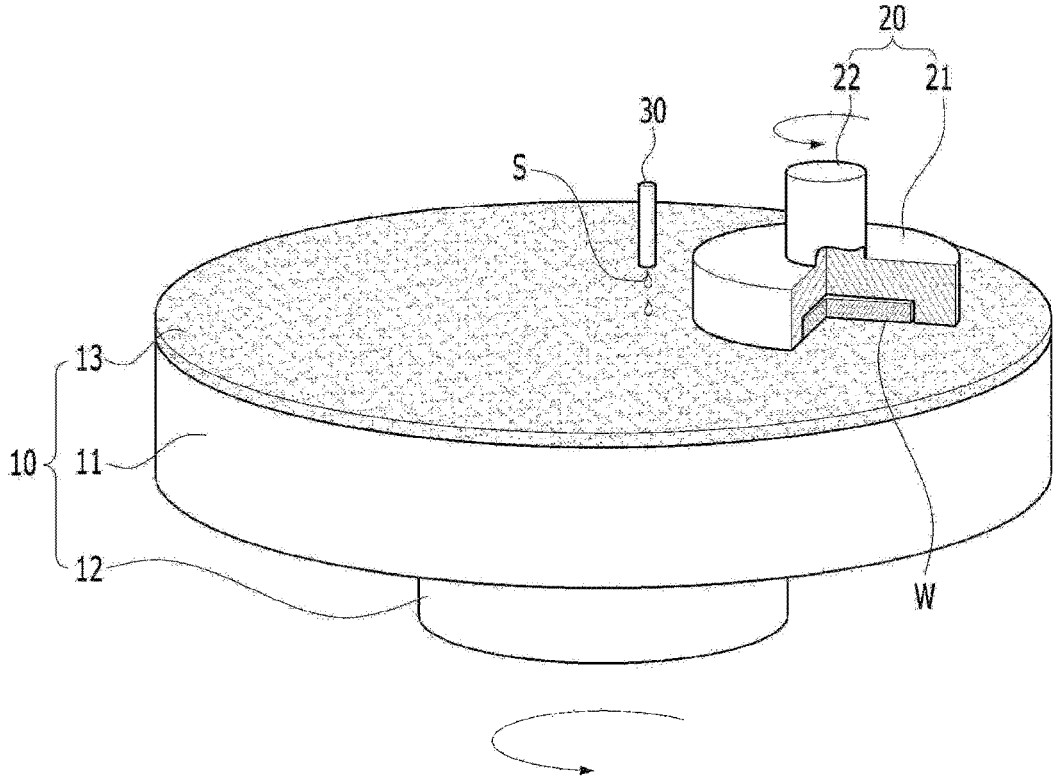
FIG. 1 is a perspective view of a general wafer polishing apparatus.
Figure 2:
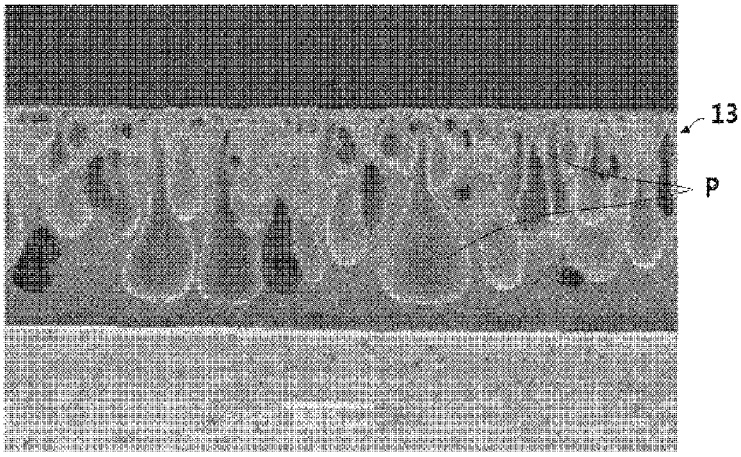
FIG. 2 illustrates a side section of a surface of an example of the polishing pad of FIG. 1.

Hereinafter, embodiments will be elucidated via description thereof with reference to the accompanying drawings. In the following description of the embodiments, it will be understood that, when an element such as a layer (film), region, pattern, or structure is referred to as being "on" or "under" another element such as a substrate, layer (film), region, pad, or pattern, it can be "directly" on or under the other element, or can be "indirectly" formed such that an intervening element may also be present. In addition, it will also be understood that the criteria for "on" or "under" is on the basis of the drawing.

In the drawings, elements may be exaggerated in size, omitted, or schematically illustrated for convenience in description and clarity. Further, the sizes of elements do not indicate the actual sizes of the elements. Wherever possible, the same reference numbers will be used throughout the drawings to refer to the same parts. Hereinafter, embodiments will be described with reference to the accompanying drawings.

Figure 5:
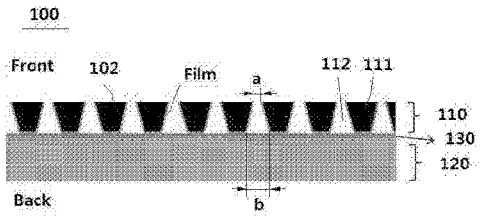
FIG. 5 is a side view of a portion of a polishing pad according to an embodiment of the present invention.

FIG. 5 is a side view of a portion of a polishing pad according to an embodiment of the present invention.

As shown in FIG. 5, a polishing pad 100 for a wafer polishing apparatus according to an embodiment of the present invention may include an upper pad 110, a lower pad 120, and an adhesive part 130.

The upper pad 110 is a part that forms an upper layer of the polishing pad 100 and is in contact with a wafer to polish the same. In more detail, the upper pad 110 may include a front portion, a back portion, and a plurality of grid grooves 112. Here, the front portion and the back portion of the upper pad 110 may be coated with a film in which various raw materials are mixed.

The front portion may have a horizontal cut surface 102 from which a film-coated surface is removed. The cut surface 102 may be formed through buffing processing, which will be described later.

The back portion may be attached to the adhesive part 130 in the state of being coated with the film.

Figure 3:
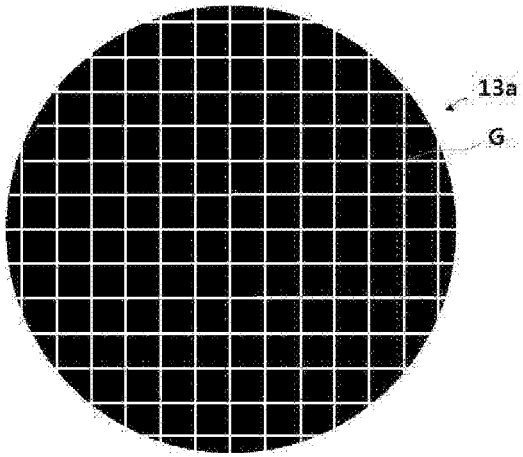
FIG. 3 is a plan view of another example of the polishing pad of FIG. 1.
Figure 4A:
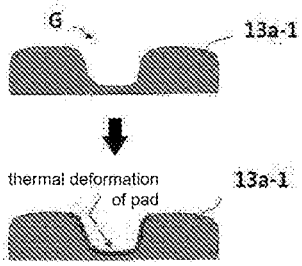
FIGS. 4A and 4B are views showing a method of forming grooves in the polishing pad through hot press processing and cutting processing.
Figure 4B:
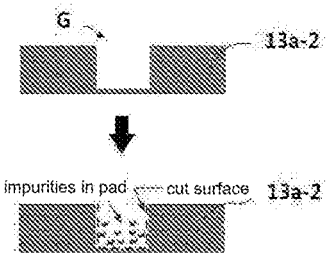

The grid grooves 112 may be arranged at regular intervals in the upper pad 110 in a form such that they penetrate the front portion and the back portion. For example, the grid grooves 112 may be arranged in the shape shown in FIG. 3. Of course, in the polishing pad 100, the intervals between the grid grooves 112 or the number of rows and columns constituting the grid grooves 112 may vary.

The grid grooves 112 may have a side section in which the bottom length b is greater than the top length a. That is, the grid grooves 112 may be formed such that the size of the entrance area contacting a wafer W is less than the size of the bottom surface area. The grid grooves 112 may be formed to have any of various sectional shapes in which the entrance area is smaller than the bottom surface area.

For example, as shown in FIG. 5, according to the embodiment, unit members 111, which form the grid grooves 112, may have a trapezoidal-shaped section in which the bottom length is less than the top length. The side surfaces of neighboring unit members 111 serve as sidewalls forming the grid grooves 112. Therefore, the grid grooves 112 may be formed such that the sectional area thereof gradually increases from the front portion of the upper pad 110 to the back portion. That is, the grid grooves 112 have a trapezoidal-shaped side section in which the bottom length b is greater than the top length a. In addition, as described above, the grid grooves 112 may have film-coated surfaces as inner walls.

The trapezoidal-shaped grid grooves 112 may exhibit effects of securing the smooth flow of slurry on the surface of the upper pad 110 and minimizing surface tension with respect to the wafer. In addition, since the front portion of each grid groove 112, i.e. the entrance contacting a wafer W, is narrower than the back portion (or the bottom surface), it is possible to minimize the discharge of impurities present in the back areas of the grid grooves 112 to the surface of the upper pad 110 and thus prevent the impurities from contaminating the wafer or adversely affecting the flatness of the wafer.

In addition, since the inner walls of the grid grooves 112 are coated with a film, the flow of the slurry may be further increased, and the generation of impurities may be reduced during the process of forming the grid grooves 112.

The above-described upper pad 110 forms one layer in which the grid grooves 112 are formed, and thus may be referred to as a nap layer of the polishing pad 100. The nap layer 110 may include a porous suede material so as to have excellent performance in removing defects from a wafer and prevent the occurrence of defects.

The lower pad 120 may be disposed below the upper pad 110 described above, and may be attached to the surface plate. The lower pad 120 may be referred to as a non-woven fabric layer of the polishing pad 100. The lower pad 120 may be coupled to the upper pad 110, and may support the upper pad 110 so that the upper pad 110 functions stably.

The adhesive part 130 may be located between the upper pad 110 and the lower pad 120, and may combine the upper pad 110 and the lower pad 120. For example, the adhesive part 130 may be an adhesive or an adhesive tape to which the back portion of the upper pad 110 and the front portion of the lower pad 120 are attached.

The polishing pad 100 for a wafer polishing apparatus of the embodiment having the above-described configuration may solve a problem in which a wafer is not readily separated after a polishing process by securing the smooth flow of slurry and minimizing surface tension using the grid grooves 112, which have a relatively narrow entrance and a relatively wide bottom (e.g. have a trapezoidal shape). In addition, it is possible to prevent reduced flatness of a wafer or degradation in LLS quality attributable to impurities during a wafer polishing process.

Hereinafter, a method of manufacturing the polishing pad 100 according to an embodiment of the present invention and the above-described structure of the polishing pad 100 will be described in more detail. Hereinafter, the upper pad 110 and the lower pad 120 of the polishing pad 100 will be referred to as a nap layer 110 and a non-woven fabric layer 120.

Figure 6:
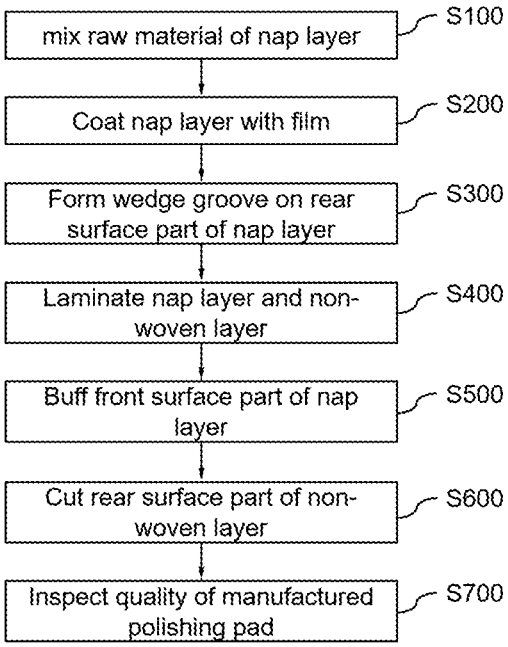
FIG. 6 is a flowchart showing a method of manufacturing a polishing pad according to an embodiment of the present invention.
Figure 7A:
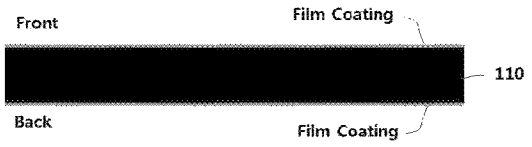
FIG. 7A illustrates a film coating step performed on the nap layer of FIG. 5.
Figure 7B:
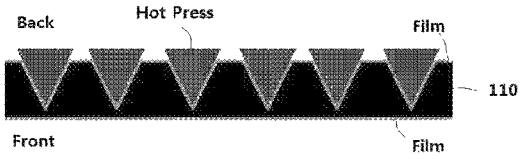
FIG. 7B illustrates a grooving step performed on the nap layer of FIG. 5.
Figure 7C:
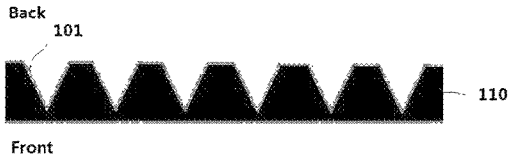
FIG. 7C illustrates a post-grooving step performed on the nap layer of FIG. 5.
Figure 7D:
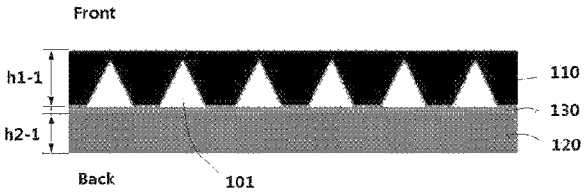
FIG. 7D illustrates a lamination step performed on the nap layer and the non-woven fabric layer of FIG. 5.
Figure 7E:
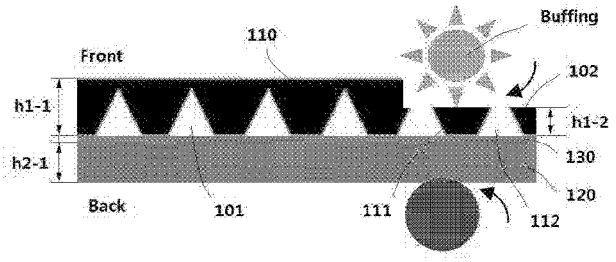
FIG. 7E illustrates a buffing step performed on the nap layer of FIG. 7D.
Figure 7F:
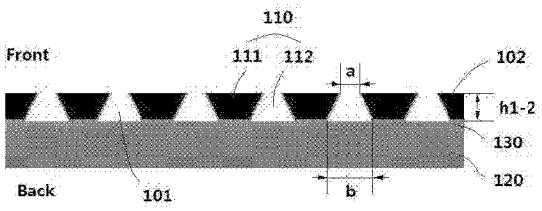
FIG. 7F illustrates a polishing pad resulting from the buffing step of FIG. 7E.

FIG. 6 is a flowchart showing a method of manufacturing a polishing pad according to an embodiment of the present invention, FIG. 7A illustrates a film coating step performed on the nap layer of FIG. 5, FIG. 7B illustrates a grooving step performed on the nap layer of FIG. 5, FIG. 7C illustrates a post-grooving step performed on the nap layer of FIG. 5, FIG. 7D illustrates a lamination step performed on the nap layer and the non-woven fabric layer of FIG. 5, FIG. 7E illustrates a buffing step performed on the nap layer of FIG. 7D, and FIG. 7F illustrates a polishing pad resulting from the buffing step of FIG. 7E.

As shown in FIG. 6, in a method of manufacturing the polishing pad 100 according to an embodiment of the present invention, a step of mixing raw materials of the nap layer 110 is first performed (S100).

In the mixing step (S100), a nap layer 110 including a porous suede material may be manufactured by appropriately mixing the raw materials for forming the nap layer 110.

Subsequently, a film coating step (S200) of coating a film on the nap layer 110 may be performed. The film coating step (S200), as shown in FIG. 7A, may be a step of coating a polyethylene (PET) film on the surface of the nap layer 110. A film may be coated on the front portion and the back portion of the nap layer 110 through the film coating step (S200).

Subsequently, a grooving step (S300) of forming wedge grooves 101 in the back portion of the nap layer 110 may be performed. The grooving step (S300), as shown in FIG. 7B, may be performed through hot pressing processing using a hot press. The wedge grooves 101 are not limited to a triangular shape, but may have any of various other shapes, such as a semicircular shape, in which the size of the back portion is greater than the size of the front portion. The shape of the wedge grooves 101 may be variously formed by changing the shape of the hot press.

In the embodiment, the grid grooves 112 of the polishing pad 100 may be formed by preferentially forming the wedge grooves 101 (refer to FIG. 7C) through the hot pressing processing performed on the back portion of the upper pad 110.

As shown in FIG. 7C, a plurality of wedge grooves 101 may be formed in the back portion of the nap layer 110 through the grooving step (S300). For example, the plurality of wedge grooves 101 may have an inverted-triangular-shaped section.

After the grooving step (S300), a lamination step (S400) of bonding the nap layer 110 and the non-woven fabric layer 120 may be performed. The lamination step (S400), as shown in FIG. 7D, may be a step of combining the nap layer 110 and the non-woven fabric layer 120 using an adhesive or an adhesive tape. In this case, the back portion of the nap layer 110 may be bonded to the front portion of the non-woven fabric layer 120 such that the wedge grooves 101 in the nap layer 110 are oriented downwards.

After the lamination step (S400), a buffing step (S500) of buffing the front portion of the nap layer 110 is performed. The buffing step (S500) is a process of removing the surface of the nap layer 110. In the buffing step (S500), as shown in FIG. 7E, the front portion of the nap layer 110 may be buffed so that the edge of each wedge groove 101, i.e. the apex of the triangle, is cut. Therefore, after the buffing step (S500), the nap layer 110 has a thickness h1-2 that is less than the thickness h1-1 in the lamination step (S400), and has a cut surface 102 at the front portion thereof.

Here, the cut surface 102 may be referred to as a buffed surface. According to the embodiment, the nap layer 110, which has the cut surface 102 at the front portion thereof, may solve the problems with the front portion formed through the conventional hot press processing, in which a portion adjacent to the grooves G is thermally deformed. Therefore, the polishing pad 100 according to the embodiment, which has the cut surface 102 at the front portion thereof, does not have a thermally deformed surface, thereby preventing direct contact between a wafer and a thermally deformed layer when contacting the wafer during the polishing process, reducing over-polishing of the side surface of the wafer, and consequently improving polishing quality.

When the buffing step (S500) is completed, as shown in FIG. 7F, the nap layer 110 is formed such that the unit members 111 forming the grid grooves 112 have a trapezoidal-shaped section in which the bottom length is less than the top length. Therefore, the grid grooves 112 may be formed such that the sectional area thereof gradually increases from the front portion of the nap layer 110 to the back portion. That is, the grid grooves 112 have a trapezoidal shape in which the bottom length b is greater than the top length a, so that the entrance area that comes into contact with a wafer is smaller than the bottom area. In addition, the grid grooves 112, as described above, may have film-coated surfaces as inner walls.

The grid grooves 112 having the above-described shape may exhibit effects of securing the smooth flow of slurry on the surface of the upper pad 110 and minimizing surface tension with respect to the wafer. In addition, since the entrance of the front portion of each grid groove 112 is narrower than the back portion, it is possible to minimize the discharge of impurities present in the back area of each grid groove 112 to the surface of the upper pad 110, thus preventing the impurities from contaminating the wafer or adversely affecting the flatness of the wafer.

In addition, since the inner walls of the grid grooves 112 are coated with a film, the flow of the slurry may be further increased, and the generation of impurities may be reduced during the process of forming the grid grooves 112.

After the buffing step (S500), a cutting step (S600) of cutting the polishing pad 100 to an arbitrary size and shape may be performed. In the cutting step (S600), the polishing pad 100 may be cut on a sheet-by-sheet basis so as to have an arbitrary size and shape. For example, in the cutting step (S600), the edge of the polishing pad 100 may be cut so that the polishing pad 100 has a circular-shaped, elliptical-shaped, or rectangular-shaped section. Subsequently, a quality inspection step (S700) of inspecting the quality of the manufactured polishing pad 100 may be performed.

As described above, according to the polishing pad 100 for a wafer polishing apparatus and the manufacturing method therefor of the present invention, the trapezoidal-shaped grid grooves 112 may secure the smooth flow of slurry, may mitigate excessive surface tension with respect to a wafer, and may prevent reduced flatness of a wafer or degradation in LLS quality attributable to impurities during a wafer polishing process.

The features, structures, effects, and the like described in association with the embodiments above are incorporated into at least one embodiment of the present invention, but are not limited only to the one embodiment. Furthermore, the features, structures, effects, and the like exemplified in association with respective embodiments can be implemented in other embodiments by combination or modification by those skilled in the art. Therefore, contents related to such combinations and modifications should be construed as falling within the scope of the present invention.

INDUSTRIAL APPLICABILITY

The polishing pad for a wafer polishing apparatus and the manufacturing method therefor of the embodiments may be used for a process of manufacturing a silicon wafer.

The invention claimed is:

1. A method of manufacturing a polishing pad for a wafer polishing apparatus, the method comprising:

a film coating step of coating a film on a nap layer;

a grooving step of forming grooves in a back portion of the nap layer;

a lamination step of bonding a non-woven fabric layer to the back portion of the nap layer; and a buffing step of buffing a front portion of the nap layer to epose the grooves.

2. The method according to claim 1, wherein the grooving step is performed through hot pressing processing.

3. The method according to claim 2, wherein in the lamination step, the nap layer and the non-woven fabric layer are combined using an adhesive or an adhesive tape.

4. The method according to claim 3, wherein in the buffing step, the front portion of the the nap layer in which edges of the grooves are included is cut such that the exposed grooves have a side section in which a bottom length is greater than a top length.

5. The method according to claim 1, wherein after the buffing step, a cutting step of cutting a polishing pad to an arbitrary size and shape is further performed.

6. The method according to claim 5, wherein before the film coating step, a mixing step of mixing raw materials of the nap layer is performed.

* * * * *